United States Patent [19]

Wallace

[11] 4,203,350

[45] May 20, 1980

[54] HYDRAULIC PERCUSSIVE MACHINES

[75] Inventor: Trevor E. Wallace, Bryanston, South Africa

[73] Assignee: The Steel Engineering Company Limited, Roodepoort, South Africa

[21] Appl. No.: 882,218

[22] Filed: Feb. 28, 1978

[30] Foreign Application Priority Data

Mar. 7, 1977 [ZA] South Africa ..... 77/1338

[51] Int. Cl.[2] ..... F01B 7/18; F01B 11/02; F01L 25/06

[52] U.S. Cl. ..... 91/235; 91/320; 91/436; 92/85 B

[58] Field of Search ..... 91/436, 12, 320, 235; 92/85 B

[56] References Cited

U.S. PATENT DOCUMENTS

| | | | |
|---|---|---|---|
| 3,701,386 | 10/1972 | Feucht . | |
| 3,887,019 | 6/1975 | Reynolds | 91/321 |
| 4,018,135 | 4/1977 | Lance | 92/85 B |
| 4,020,747 | 5/1977 | Reynolds . | |

*Primary Examiner*—Paul E. Maslousky
*Attorney, Agent, or Firm*—Young & Thompson

[57] ABSTRACT

A hydraulic percussive machine comprising a piston and cylinder with a dashpot at the front end to cushion overtravel of the piston. Heat is removed from the dashpot by admitting pressure fluid to the return stroke chamber through a front chamber and the dashpot. On the pressure stroke fluid from the return stroke chamber is admitted to the working stroke chamber in one case by causing all flow to take place along that route and in the other place by having two feeds to the working stroke chamber with a flow restrictor in the direct feed line.

5 Claims, 2 Drawing Figures

HYDRAULIC PERCUSSIVE MACHINES

BACKGROUND TO THE INVENTION

This invention relates to hydraulic percussive machines such as rock drills.

In such machines it has already been proposed to dampen the stroke of the piston under no-load conditions by providing a dashpot into which a flange on the piston moves on the working stroke. As a result of the dampening action heat is generated in the fluid trapped in the dashpot and unless that heat be dissipated overheating can occur after repeated no-load conditions, e.g. with hand-held machines operated by inexperienced operators or operated in difficult ground.

The dashpot is usually at the forward end of a chamber at the front end of the drilling machine. As it were the dashpot forms a dead end to that chamber. In one such prior proposal (see U.S. Pat. No. 4,020,747) it has been proposed to have the chamber in series with the valve controlling the working stroke so that on the working stroke fluid flows through the chamber and to the valve. Eventually the fluid thus flowing goes to tank. However, since the dashpot is a dead end to the chamber and there is little or no agitation of the fluid in the dashpot, not much of the overheated fluid in the dashpot gets into circulation so that after prolonged no-load working, overheating is bound to occur.

SUMMARY OF THE INVENTION

According to the invention a hydraulic percussive machine comprises:

- a piston,
- a cylinder in which the piston is caused to reciprocate,
- a cushioning flange on the forward end of the piston,
- a first space in the cylinder in which the cushioning flange normally moves,
- a dashpot at the forward end of the first space into which the cushioning flange can move on overtravel of the piston during the power stroke of the piston to trap fluid in the dashpot,
- a second space in the cylinder,
- a second shoulder on the backward end of the piston operating in the second space,
- a control valve for admitting pressure fluid to the second space on the working stroke and exhausting pressure fluid from the second space on the return stroke,
- a first inlet for pressure fluid to the dashpot at its forward end, and
- an outlet from the first space leading to the control valve so that when that valve admits fluid to the second space fluid from the first space flows into the second space.

In other words the dashpot, the chamber and the valve are in series with one another for at least part of the fluid used to perform the working stroke.

The series flow according to the invention is conveniently achieved by means of the apparatus shown in the complete specification of South African patent No. 76/1650 in which the first space on the working stroke is connected between the pressure source and the valve intake while the connection from the source to the intake is closed off or restricted to ensure flow through the first space.

DESCRIPTION OF PREFERRED EMBODIMENTS

Figure 1:
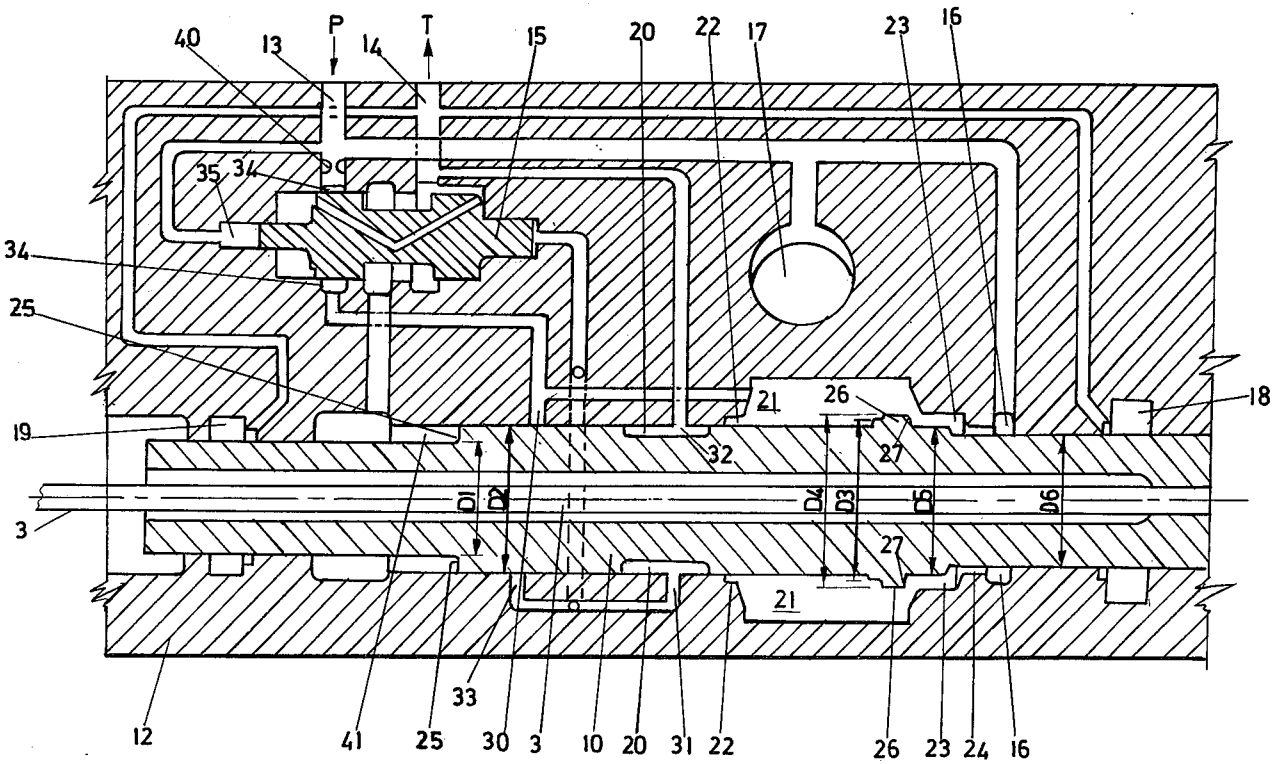
FIG. 1 is a section through a drilling machine according to the invention.

In FIG. 1 a piston 10 with an axial water tube 3 is illustrated, but for some drilling operations and for pavement breakers the water tube need not be present. The piston 10 operates in a cylinder block 12. The block 12 is formed with various passages and cavities described later on. In the drawing they are all shown in one plane, but in practice they will be distributed around the block 12 to lessen its bulk and diameter.

The block is formed with an inlet 13 connected to high pressure fluid acting in the direction of the arrow P and an outlet 14 connected to tank so that fluid can flow in the direction of the arrow T.

The inlet 13 is connected in the first place to a shuttle valve 15 of a well known type where it is applied at a position 35 and to an annular groove 34. Secondly it leads to an annular space 16 around the front end of the piston 10 and to an accumulator 17.

The outlet 14 is connected in a well known manner to the front and back seals 18 and 19 of the machine, to the valve 15 and to a port 32 formed in the cylinder 12. Also in the cylinder is a large annular cavity 21 which at the back end of the machine leads to a rear cushion space 22. At the front the cavity 21 narrows into a front cushion space 23 and a front cylinder space 24 leading from the annular space 16.

In the position illustrated flow can take place from the inlet, through the spaces 16, 24 and 23 to the cavity 21. From the cavity 21 there are two connections. The first is to a port 30. The second is to the annular groove 34. The groove 34 is thus fed directly from the inlet 13 and also from the cavity 21. For the purposes of the present invention a flow restrictor 40 is provided in the path from the inlet 13 to the groove 34.

The piston varies in diameter from back to front. At the back it has a diameter D1 which at an annular shoulder 25 changes to D2.

At a stepped flange 26 the diameter increases first to D3 and then to D4. The front end of the flange 26 steps down to a diameter D5 and at an annular shoulder 27 the final diameter becomes D6. The piston also has a timing groove 20.

The relationships among areas related to some of these various diameters are important. Thus related areas D2–D1 must be larger than related areas D2–D6 so that with equal pressures acting on the resulting areas a power stroke can be achieved. In addition related areas D2–D1 must also be larger than related areas D3–D6. Apart from the obvious requirement that D5 must be larger than D6 and D4 larger than D5, the diameters D5 and D4 can be chosen almost at will to suit the desired characteristics of the machine.

The shuttle valve 15 is also connected at its right hand end to a port 31. As shown the port 31 opens into the timing groove 20. On the opposite side a port 32 also opening into the timing groove 20 is connected to tank. As a result the valve 15 has now connected the space 41 above the shoulder 25 to tank so that the return stroke can commence. During that return stroke the shoulder 27 and the flange 26 clear the spaces 24 and 23 so that the cavity 21 is now connected to the inlet 13 and thus in turn connects the groove 34 to the inlet via the cavity 21 and bypassing the flow restrictor 40.

In the movement of the piston to the left the timing groove 20 uncovers the port 30 and also a port 33 which connects with the right hand end of the valve 15. Due to differential piston areas of the valve 15 it moves to the left to connect the groove 34 to a space 41 behind the shoulder 25 to pressure.

The piston 10 then moves to the right and fluid from the inlet 13 and the space 21 moves into the space 41. While the piston 10 moves and accelerates the accumulator 17 discharges mostly along the path through the cavity 21. The flow restrictor 40 is chosen to split the flow in the required fashion. Fluid from the space 23 (which acts as a dashpot) thus lands into the main stream of fluid which on the next return stroke passes to tank.

The dashpot action is as follows:

Assume that the piston does not strike a tool stem so that travel to the right is not arrested by the tool. In such a case the piston keeps on going to the right under its acquired kinetic energy. The shoulder 27 enters the space 24 and the flange 26 enters the space 23 which is now closed at both ends except for such clearances as may be necessary or may be allowed due to design considerations. The flange 26 thus enters a cushion of hydraulic fluid. The groove 20 connects the cavity 21 to the port 32 so that the cavity is now relieved to tank. There is thus a cushion pressure of a high order to the front of the flange 26 and tank pressure at its rear. At the same time the piston area of the shoulder 27 is exposed to system pressure. The return stroke takes place smoothly without any stalling or cavitation.

Overtravel to the left is cushioned by the rear step of the flange 26 entering the space 22. In this case there is no need to vent the space 21 as the differential areas are sufficient to allow smooth operation.

Figure 2:
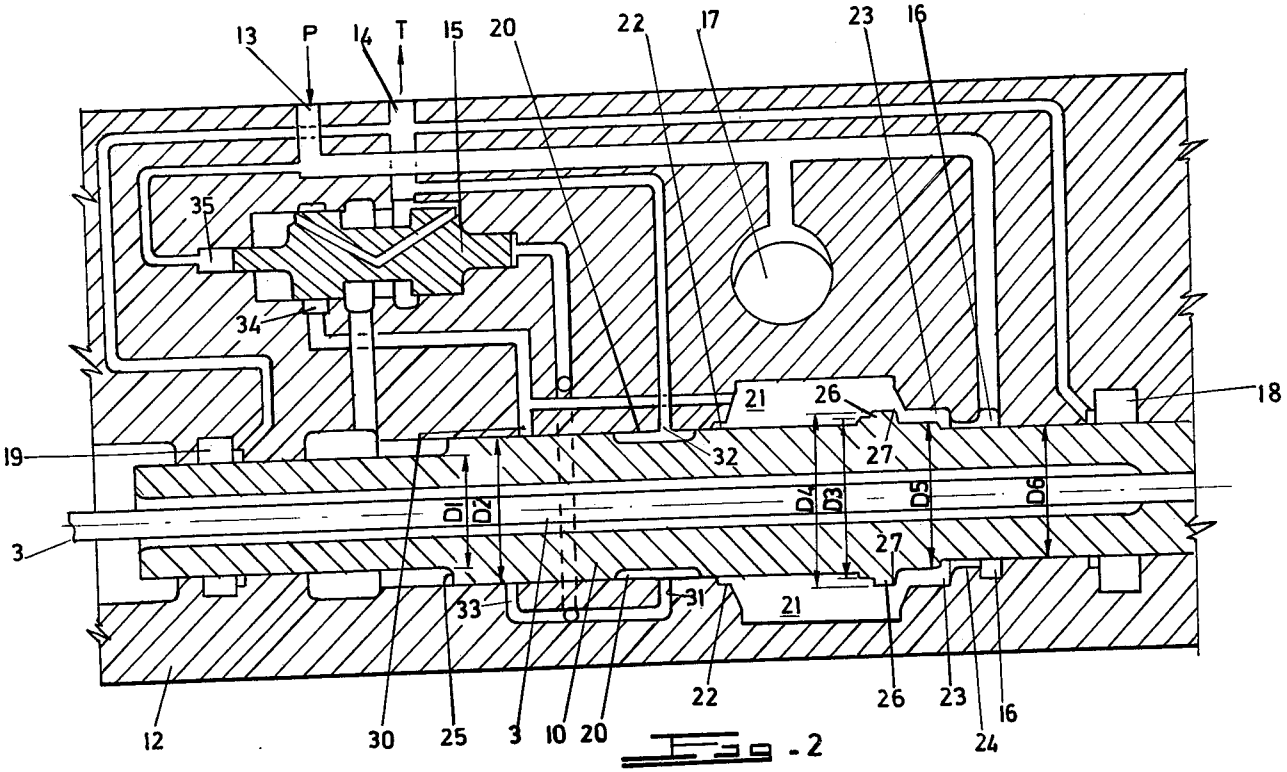
FIG. 2 is a section similar to FIG. 1 of another embodiment.

As can be seen the embodiment of FIG. 2 is identical to that of FIG. 1 except that the flow restrictor 40 has been removed and that there is no direct connection between the inlet 13 and the groove 34. Thus all flow from the inlet 13 to the space 41 takes place through the cavity 21 and the spaces leading into it. Of course, in this embodiment the path from the space 21 to the groove 34 will be large or there will be more than one such path to take the necessary flow.

I claim:

1. A hydraulic percussive machine comprising: a piston, a cylinder in which the piston is caused to reciprocate, a cushioning flange on the forward end of the piston, a cavity in the cylinder in which the cushioning flange normally moves, a dashpot at the forward end of the cavity into which the cushioning flange can move on overtravel of the piston during the power stroke of the piston to trap fluid in the dashpot, a rear space in the rear of the cylinder, a shoulder on the backward end of the piston operating in the rear space, a control valve for admitting pressure fluid to the rear space on the working stroke and exhausting pressure fluid from the rear space on the return stroke, an inlet to the dashpot at its forward end, means to supply pressure fluid to said inlet from a source outside said cylinder whereby the last-named fluid first enters the dashpot and then proceeds to said cavity, and an outlet from the cavity leading to the control valve so that when that valve admits fluid to the rear space fluid from the cavity flows into the rear space.

2. The machine claimed in claim 1 including a second inlet for pressure fluid to the control valve and a flow means for restricting the flow of pressure fluid through the second inlet so that on admission of pressure fluid to the rear space some fluid flows to the latter from the cavity.

3. The machine claimed in claim 1 in which the piston has a second shoulder on the piston immediately forwardly of the cushioning flange, the second shoulder closing the forward end of the dashpot and the first inlet being forwardly of that end.

4. A hydraulic percussive machine comprising:

a piston, a cylinder in which the piston is caused to reciprocate, a cavity at the front of the cylinder around the piston, a dashpot leading from the cavity and of lesser diameter than the cavity, an inlet space leading from the dashpot and of lesser diameter than the dashpot, a working space at the back of the cylinder around the piston, a first shoulder on the piston which fits into the inlet space, a flange on the piston which fits into the dashpot, a second shoulder at the back end of the piston operating in the working space, an inlet for pressure liquid to the forward end of the inlet space, a control valve for admitting pressure liquid to the working space on the working stroke and exhausting pressure liquid from it on the return stroke, a channel from the cavity to the control valve so that when that valve admits pressure fluid to the working space fluid flows from the inlet space through the dashpot and the cavity into the working space, the first shoulder sealing off the inlet space from the cavity on overtravel of the piston and the flange entering the dashpot on such overtravel to provide a dashpot action, and means for connecting the cavity to the exhaust on such overtravel.

5. The machine claimed in claim 4 including a second inlet for pressure fluid to the control valve and a flow means for restricting the flow of pressure fluid through the second inlet so that on admission of pressure fluid to the working space some fluid flows to the latter from the cavity.

* * * * *